US007513606B2

(12) United States Patent
Nystrom et al.

(10) Patent No.: US 7,513,606 B2
(45) **Date of Patent: *Apr. 7, 2009**

(54) FLUID COUPLER AND A DEVICE ARRANGED WITH THE SAME

(75) Inventors: Peter J Nystrom, Webster, NY (US); John R Andrews, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/015,676

(22) Filed: Jan. 17, 2008

(65) Prior Publication Data

US 2008/0113156 A1 May 15, 2008

Related U.S. Application Data

(62) Division of application No. 11/132,470, filed on May 19, 2005, now Pat. No. 7,331,655.

(51) Int. Cl.
*B41J 2/05* (2006.01)

(52) U.S. Cl. ..... 347/56; 347/65

(58) Field of Classification Search ..... 347/20, 347/56, 61–65, 67, 92–94
See application file for complete search history.

(56) References Cited

U.S. PATENT DOCUMENTS 4,905,017 A * 2/1990 Sugitani et al. ..... 347/65
7,331,655 B2 * 2/2008 Nystrom et al. ..... 347/56

* cited by examiner

*Primary Examiner*—Juanita D Stephens
(74) *Attorney, Agent, or Firm*—Gibb I.P. Law Firm, LLC

(57) ABSTRACT

Plural film layers are disposed on a substrate. Each film layer has regions devoid of film material, thus forming film layer cavity openings. Each film layer has its cavities arranged to provide fluid coupling with its adjacent film layer or layers. The film layer cavities form a traverse channel coupling the top and bottom film layers and also one or more lateral channels coupling cavity openings in the top film layer. The film layer traverse channel couples with a substrate channel that extends from the substrate top surface to one or more of its other surfaces. A device such as a fluid dispenser, fluid ejector, sensor or bioprocessing device is disposed on the top film layer and fluidly coupled to the plural film layers traverse and lateral channels. The traverse channel and the one or more lateral channels are arranged to transport or flow one or more fluids.

15 Claims, 8 Drawing Sheets

FLUID COUPLER AND A DEVICE ARRANGED WITH THE SAME

This is a divisional of its commonly-assigned parent application Ser. No. 11/132,470 filed 19 May 2005, now U.S. Pat. No. 7,331,655, by the same inventors hereof, now pending, and claims the priority benefit of the same application under the provisions of 35 U.S.C. section 120.

INCORPORATION BY REFERENCE OF OTHER U.S. PATENTS

The disclosures of the following fifteen (15) U.S. patents are hereby incorporated by reference, verbatim, and with the same effect as though the same disclosures were fully and completely set forth herein:

John R. Andrews et al., "Precision laser cutting of adhesive members", U.S. Pat. No. 6,229,114 B1;

John R. Andrews et al., "Methods for forming features in polymer layers", U.S. Pat. No. 6,596,644 B1;

Charles P. Coleman et al., "Method of fabricating a fluid drop ejector", U.S. Pat. No. 6,127,198;

Charles P. Coleman et al., "Fluid drop ejector", U.S. Pat. No. 6,318,841 B1;

Frank C. Genovese et al., "Magnetically actuated ink jet printing device", U.S. Pat. No. 6,234,608 B1;

Arthur M. Gooray et al., "Magnetic drive systems and methods for a micromachined fluid ejector", U.S. Pat. No. 6,350,015 B1;

Arthur M. Gooray et al., "Micromachined fluid ejector systems and methods", U.S. Pat. No. 6,367,915 B1;

Arthur M. Gooray et al., "Fluid ejection systems and methods with secondary dielectric fluid", U.S. Pat. No. 6,406,130 B1;

Arthur M. Gooray et al., "Bi-directional fluid ejection systems and methods", U.S. Pat. No. 6,409,311 B1;

Arthur M. Gooray et al., "Micromachined fluid ejector systems and methods having improved response characteristics", U.S. Pat. No. 6,416,169 B1;

Arthur M. Gooray et al., "Electronic drive systems and methods", U.S. Pat. No. 6,419,335 B1;

Joel A. Kubby et al., "Micro-electro-mechanical fluid ejector and method of operating same", U.S. Pat. No. 6,357,865 B1;

Joel A. Kubby et al., "Method of fabricating a micro-electro-mechanical fluid ejector", U.S. Pat. No. 6,662,448 B2;

Eric Peeters et al., "Print head for use in a ballistic aerosol marking apparatus", U.S. Pat. No. 6,116,718; and Kia Silverbrook, "Method of manufacture of a thermally actuated ink jet including a tapered heater element", U.S. Pat. No. 6,180,427 B1.

BACKGROUND

Traditional die attach methods employ liquid or paste adhesives applied by dispensing, screen printing or stamping. Die cut film adhesives or epoxy preforms also have been developed. When there is a need to provide functionality beyond pure attachment, such as fluidic, pneumatic or other media interface, pathways must be designed. These pathways must not leak or cross-communicate. It is difficult to ensure both functions are satisfied, especially at higher densities. Material flow (squeeze out) can obstruct these features, thus requiring significant assembly tolerances and careful assembly. Fixturing is typically required to assist in the assembly to maintain tolerances. All of these aspects become increasingly difficult as multiple unique material interfaces are needed.

SUMMARY

In a first aspect of the invention, there is described a fluid coupler comprising plural film layers disposed on the substrate top surface of an included substrate, the plural film layers disposed with respect to one another to define a top film layer and a bottom film layer, the top film layer defining a film layer top surface and the bottom film layer defining a film layer bottom surface, each film layer having two opposing film layer sides with a corresponding film layer thickness or spacing therebetween, each film layer further having one or more regions that are devoid of film material, each film layer thus forming one or more cavities with corresponding cavity openings on both of its film layer sides, each film layer having one or more of its cavities disposed to provide fluid coupling with its respective adjacent film layer or with both of its respective adjacent film layers, as the case may be, the plural film layers disposed to form at least one film layer traverse channel coupling at least one cavity opening in the film layer top surface with at least one cavity opening in the film layer bottom surface.

In a second aspect of the invention, there is described a fluid coupler comprising plural film layers disposed on the substrate top surface of an included substrate, the plural film layers disposed with respect to one another to define a top film layer and a bottom film layer, the top film layer defining a film layer top surface, each film layer having two opposing film layer sides with a corresponding film layer thickness or spacing therebetween, each film layer further having one or more regions that are devoid of film material, each film layer thus forming one or more cavities with corresponding cavity openings on both of its film layer sides, each film layer having one or more of its cavities disposed to provide fluid coupling with its respective adjacent film layer or with both of its respective adjacent film layers, as the case may be, the plural film layers thus forming one or more film layer lateral channels, each film layer lateral channel coupling a corresponding group of cavity openings in the film layer top surface.

In a third aspect of the invention, there is described an arrangement comprising a device and a fluid coupler, the fluid coupler comprising plural film layers disposed on the substrate top surface of an included substrate, the plural film layers disposed with respect to one another to define a top film layer and a bottom film layer, the top film layer defining a film layer top surface, each film layer having two opposing film layer sides with a corresponding film layer thickness or spacing therebetween, each film layer further having one or more regions that are devoid of film material, each film layer thus forming one or more cavities with corresponding cavity openings on both of its film layer sides, each film layer having one or more of its cavities disposed to provide fluid coupling with its respective adjacent film layer or with both of its respective adjacent film layers, as the case may be, the device arranged to fluidly couple with one or more cavity openings in the film layer top surface.

In a fourth aspect of the invention, there is described an arrangement comprising a device and a fluid coupler, the fluid coupler comprising plural film layers disposed on the substrate top surface of an included substrate, the plural film layers disposed with respect to one another to define a top film layer and a bottom film layer, each film layer having two opposing film layer sides with a corresponding film layer thickness or spacing therebetween, each film layer further having regions that are devoid of film material, thus forming film layer cavities with corresponding cavity openings in both of the film layer's sides, each film layer having its cavities disposed to provide fluid coupling with its adjacent film layer or with its adjacent film layers, as the case may be, the plural film layers thus forming a film layer traverse channel coupling the top film layer and the bottom film layer and further forming one or more film layer lateral channels coupling cavity openings in the top film layer, the film layer traverse channel fluidly coupling with a substrate channel comprised in the substrate top surface and extending to one or more additional substrate surfaces, the device fluidly coupled with one or more of the film layer traverse channel and the one or more film layer lateral channels.

DETAILED DESCRIPTION

Briefly, a fluid coupler comprises plural film layers disposed on the substrate top surface of an included substrate. The plural film layers are disposed with respect to one another to define a top film layer and a bottom film layer. Each film layer includes two opposing film layer sides with a corresponding film layer thickness or spacing therebetween. Each film layer further includes regions that are devoid of film material, thus forming film layer cavities with corresponding cavity openings in both of the film layer's sides. Each film layer has its cavities disposed to provide fluid coupling with its adjacent film layer or with its adjacent film layers, as the case may be. The plural film layers thus form a film layer traverse channel coupling the top film layer and the bottom film layer. The plural film layers further form one or more film layer lateral channels coupling cavity openings in the top film layer. The film layer traverse channel fluidly couples with a substrate channel comprised in the substrate top surface and extending to one or more additional substrate surfaces. A device is disposed on the top film layer and arranged to fluidly couple with one or more of the film layer traverse channel and the one or more film layer lateral channels.

Figure 1:
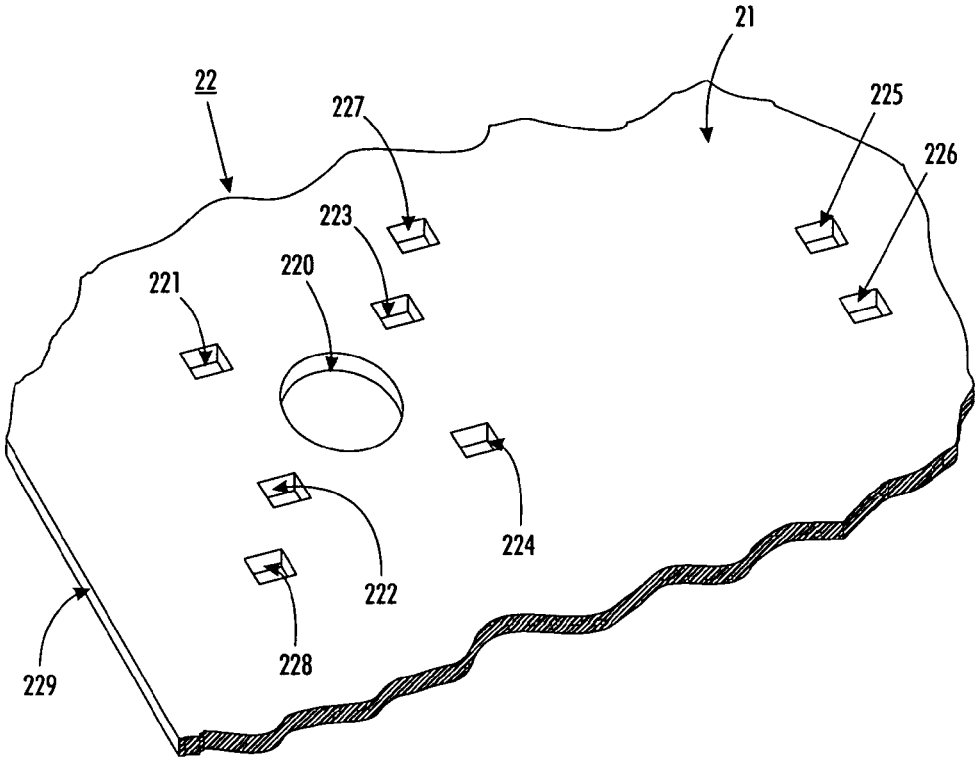
FIG. 1 is a cropped, elevated view of a first film layer 22.

Referring to FIG. 1, there is shown a cropped, elevated view of a first film layer 22 having two opposing film layer sides with a corresponding film layer thickness or spacing 229 therebetween. The film layer 22 includes regions that are devoid of film material, thus forming the depicted circular-shaped cavity 220 and the eight (8) rectangular- or square-shaped cavities 221-228. Each film layer cavity 220-228 includes corresponding cavity openings on both of its film layer sides. In one embodiment, the first film layer 22 has a thickness 229 of about 1 milli-meter ("mm").

Figure 2:
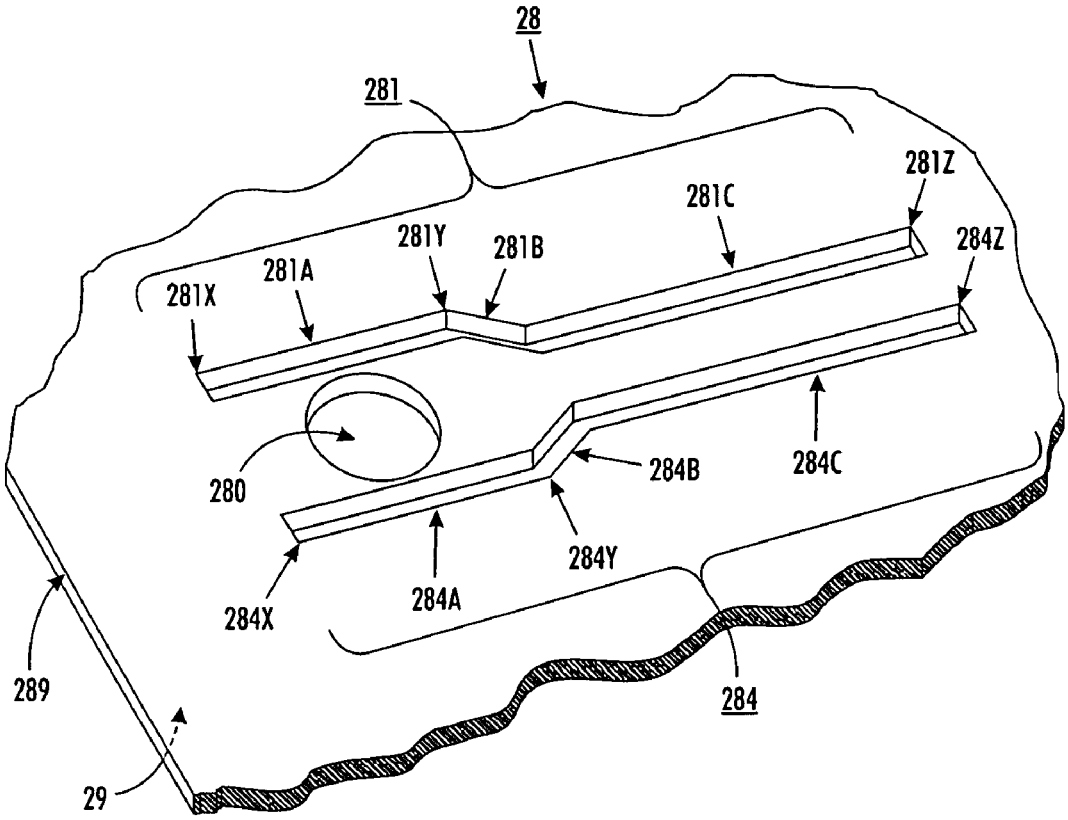
FIG. 2 is a cropped, elevated view of a second film layer 28.

Referring to FIG. 2, there is shown a cropped, elevated view of a second film layer 28 having two opposing film layer sides with a corresponding film layer thickness or spacing 289 therebetween. The film layer 28 includes regions that are devoid of film material, thus forming the depicted circular-shaped cavity 280 and the two (2) elongated cavities 281 and 284. Each film layer cavity 280, 281 and 284 includes corresponding cavity openings on both of its film layer sides. As shown, the first elongated cavity 281 is disposed to the left of the circular cavity 280 and comprises first, second, and third cavity segments 281A, 281B and 281C, each cavity segment 281A, 281B, and 281C being elongated and generally rectangular-shaped. As shown, the second elongated cavity 284 is disposed to the right of the circular cavity 280 and comprises first, second, and third cavity segments 284A, 284B and 284C, each cavity segment 284A, 284B, and 284C being elongated and generally rectangular-shaped. In one embodiment, the second film layer 28 has a thickness 289 of about 1 mm.

Figure 3:
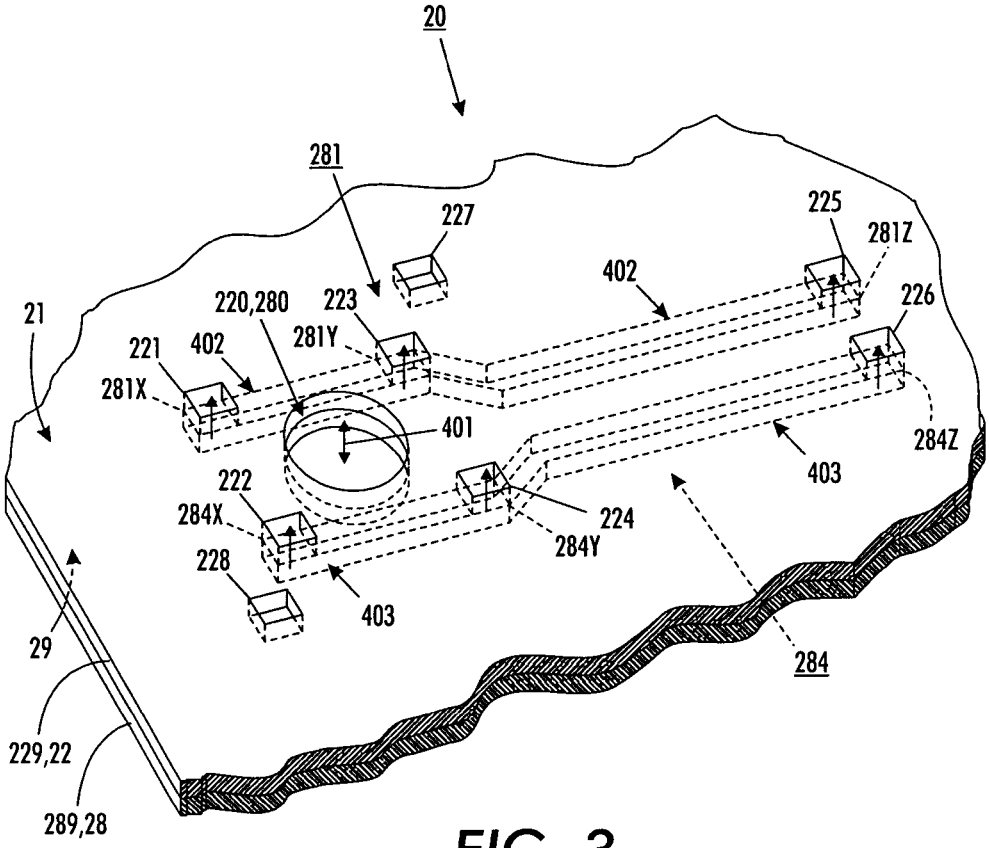
FIG. 3 is a cropped, elevated view of plural film layers 20 comprising the film layer 22 of FIG. 1 disposed on the film layer 28 of FIG. 2.

Referring to FIG. 3, there is shown a cropped, elevated view of plural film layers 20 comprising the film layer 22 of FIG. 1 disposed on the film layer 28 of FIG. 2. As shown, the plural film layers 22 and 28 are disposed with respect to one another to define a top film layer 22 and a bottom layer 28. In turn, the top film layer 22 defines a film layer top surface 21 and the bottom film layer 28 defines a film layer bottom surface 29. The top film layer 22 has one or more of its cavities 220-228 disposed to provide fluid coupling with its adjacent film layer, namely, the bottom film layer 28. Also, the bottom film layer 28 has one or more of its cavities 280, 281 and 284 disposed to provide fluid coupling with its adjacent film layer, namely, the top film layer 22. The plural film layers 20 thus form the three (3) film layer channels depicted by reference numbers 401, 402 and 403.

Still referring to FIG. 3, the depicted channel 401 comprises a film layer traverse channel 401 that couples the top film layer cavity 220 and the bottom film layer cavity 280. As shown, the cylindrical-shaped film layer traverse channel 401 extends vertically between the film layer top surface 21 and the film layer bottom surfaces 29.

Referring still to FIG. 3, the depicted channel 402 comprises a film layer first lateral channel 402 that couples a first group of cavities 221, 223 and 225 in the top film layer 22 with the left-hand elongated cavity 281 in the bottom film layer 28. As shown, the film layer first lateral channel 402 extends laterally from front to back on the left-hand side of the vertical film layer traverse channel 401.

Still referring to FIG. 3, the depicted channel 403 comprises a film layer second lateral channel 403 that couples a second group of cavities 222, 224 and 226 in the top film layer 22 with the right-hand elongated cavity 284 in the bottom film layer 28. As shown, the film layer second lateral channel 403 extends laterally from front to back on the right-hand side of the vertical film layer traverse channel 401.

Referring still to FIG. 3, the dimensions of all features depicted therein can vary from the order of microns ($10^{-6}$ meter) to millimeters ($10^{-3}$ meter) or more.

Figure 4:
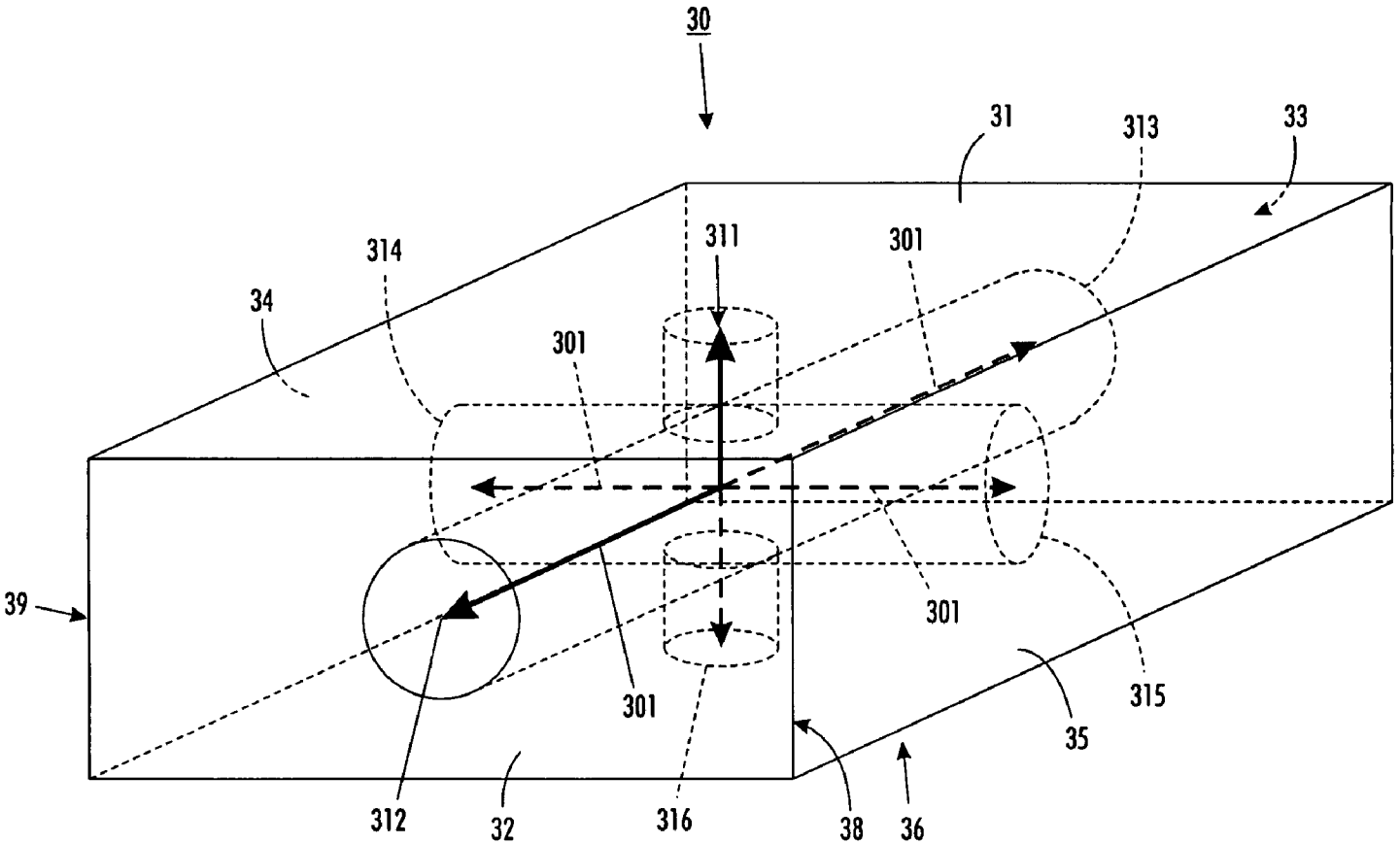
FIG. 4 is an elevated, perspective view of a substrate 30.

Referring to FIG. 4, there is shown an elevated, perspective view of a substrate 30. As shown, the substrate 30 comprises a substrate channel 301 coupling a circular-shaped substrate opening 311 in the substrate top surface 31 with one or more additional circular-shaped substrate openings 312-316 comprised in one or more substrate surfaces of an included substrate front surface 32, substrate back surface 33, substrate left side surface 34, substrate right side surface 35 and substrate bottom surface 36.

Figure 5:
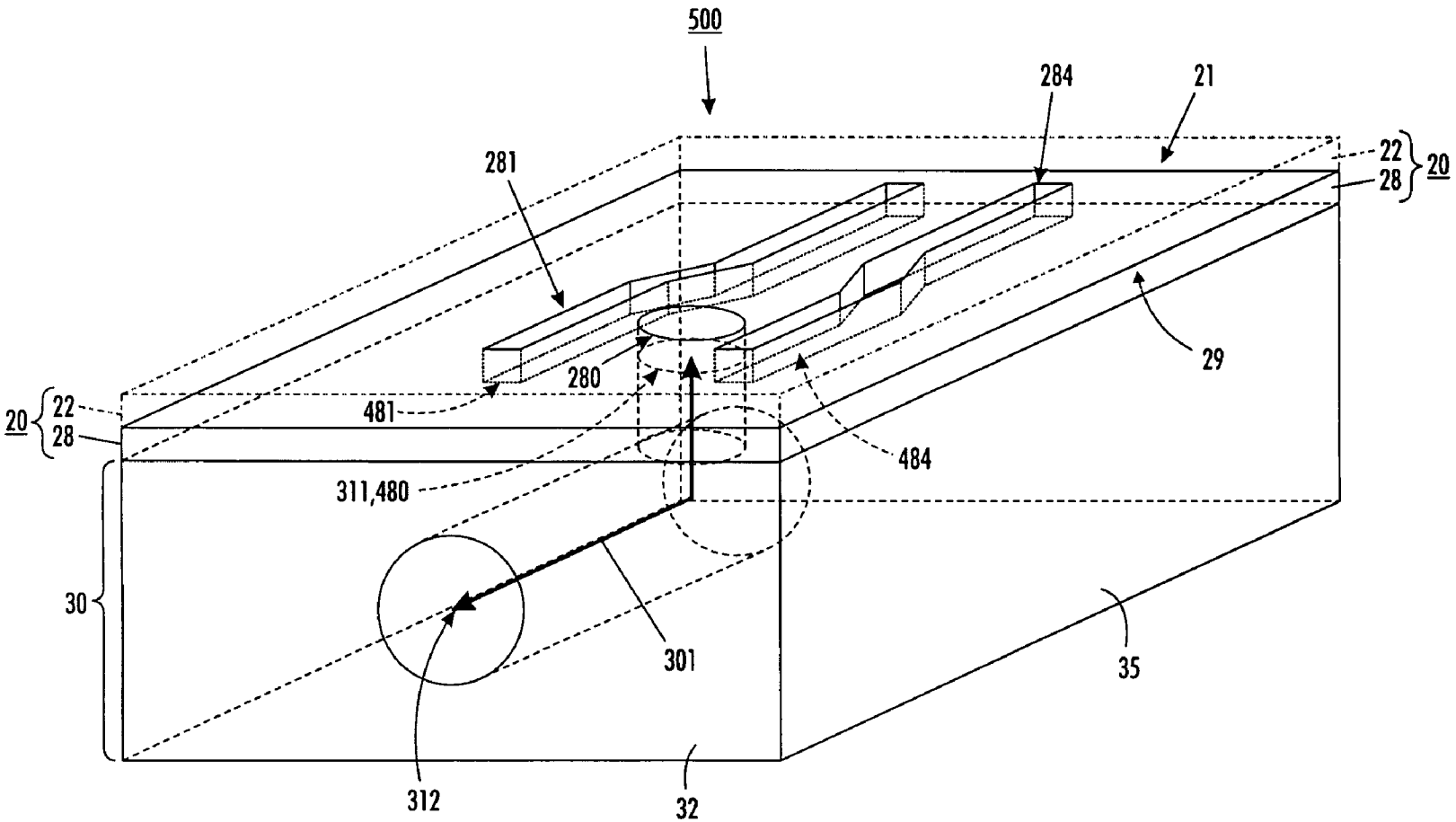
FIG. 5 is an elevated, perspective view of a first embodiment of a fluid coupler 500, in accordance with the present invention. As shown, the fluid coupler 500 comprises the plural film layers 20 of FIG. 3 disposed on the substrate 30 of FIG. 4.

Referring to FIG. 5, there is shown an elevated, perspective view of a first embodiment of a fluid coupler 500, in accordance with the present invention. The fluid coupler 500 comprises the plural film layers 20 disposed on the substrate top surface 31 of the substrate 30. The cylindrical-shaped cavity 280 in the bottom film layer 28 is generally congruent and aligned with the substrate opening 311 in the substrate top surface 31. With momentary cross-reference to FIG. 3, it will be understood that the film layer traverse channel 401 thus fluidly couples with the substrate channel 301. As shown in FIG. 5, the cavities 280, 281 and 284 in the bottom film layer 28 form the respective cavity openings 480, 481 and 484 in the film layer bottom surface 29.

Figure 6:
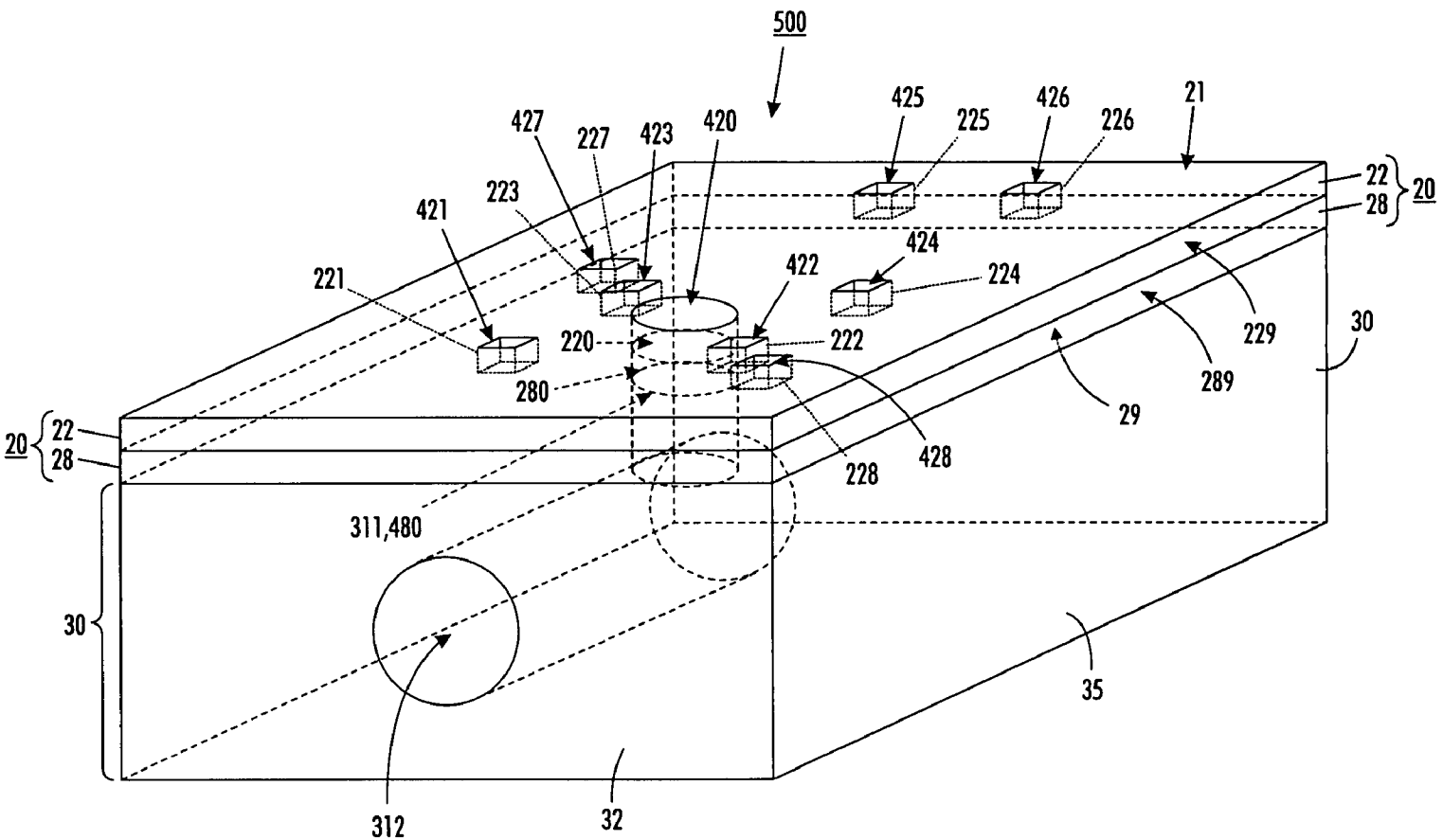
FIG. 6 is a further view of the fluid coupler 500 of FIG. 5.

Referring to FIG. 6, there is shown a further view of the fluid coupler 500 of FIG. 5. As shown, the film layer cavities 220 and 280 of the respective top and bottom film layers 22 and 28 both substantially align with the substrate opening 311. As a result, the film layer traverse channel 401 thus fluidly couples with the substrate channel 301.

As shown in FIG. 6, with cross-reference to the prior FIG. 5, the three (3) cavities 221, 223 and 225 of the top film layer 22 align and fluidly couple with the cavity 281 of the bottom film layer 28, thus forming the film layer first lateral channel 402.

As further shown by FIGS. 5-6, the three (3) cavities 222, 224 and 226 of the top film layer 22 align and fluidly couple with the cavity 284 of the bottom film layer 28, thus forming the film layer second lateral channel 403.

Still referring to FIG. 6, the nine (9) cavities 220, 221, 222, 223, 224, 225, 226, 227 and 228 in the top film layer 22 form the respective cavity openings 420, 421, 422, 423, 424, 425, 426, 427 and 428 in the film layer top surface 21.

Still referring to FIG. 6, the following sentences refer to various embodiments of the fluid coupler 500:

In one embodiment, the plural layers 20 comprise exactly two (2) film layers 22, 28.

In one embodiment, the plural film layers 20 comprise three (3) or more film layers.

In one embodiment, the plural film layers 20 comprise layers of structural bonding tape, adhesive films or double-sided tape.

In one embodiment, the substrate 30 comprises a metal such as, for example, aluminum.

In one embodiment, the substrate 30 comprises a plastic.

In one embodiment, the substrate 30 comprises a film material similar or identical to the film material comprised in the plural film layers 20.

In one embodiment, the substrate 30 comprises one or more layers of structural bonding tape, adhesive films or double-sided tape.

In one embodiment, the substrate 30 comprises a glass, a ceramic, a crystalline or a polymer film material.

Figure 7:
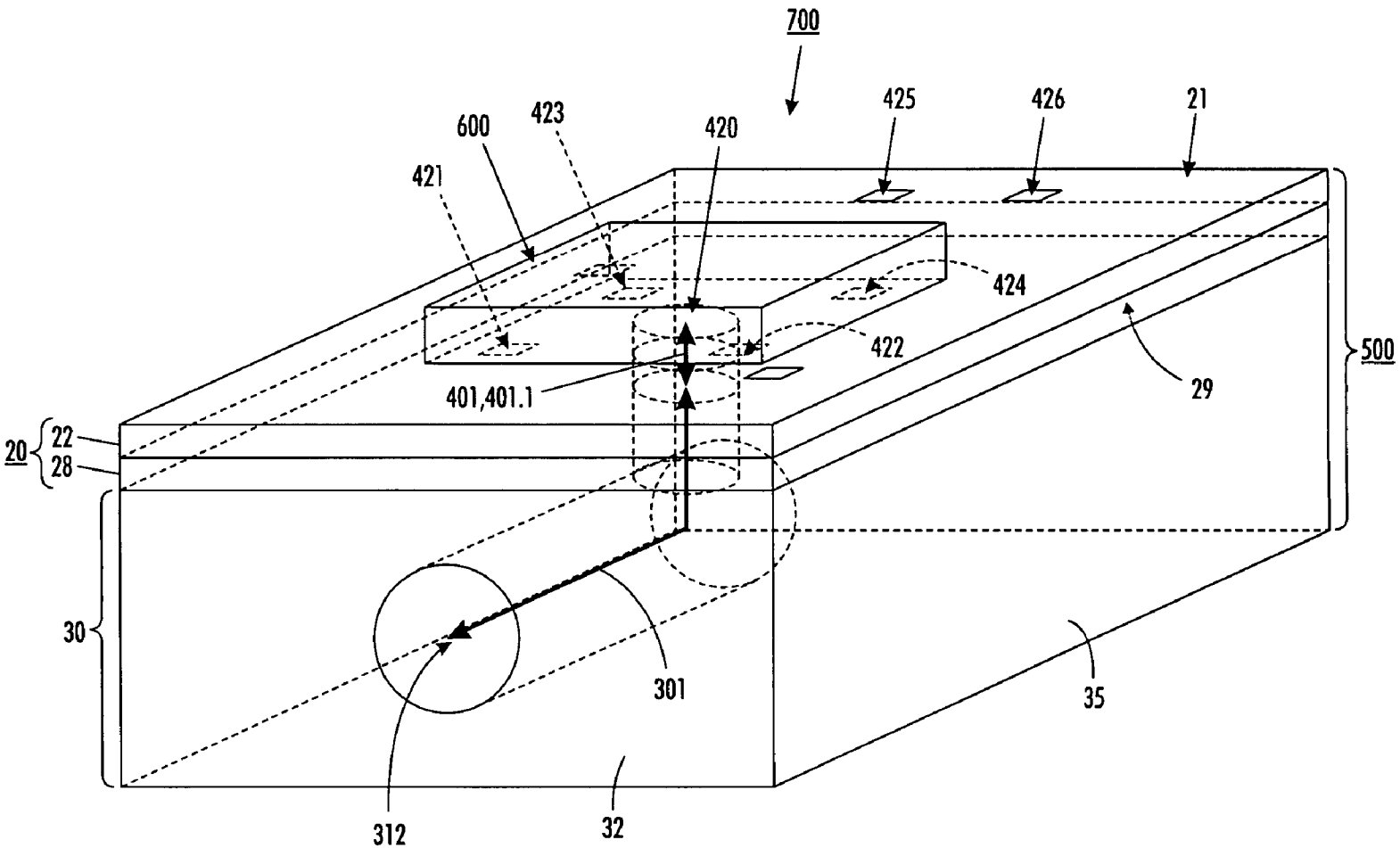
FIG. 7 is an elevated, perspective view of a first embodiment of an arrangement 700 of a device 600 and the fluid coupler 500 of FIGS. 5-6.

Referring to FIG. 7, there is shown an elevated, perspective view of a first embodiment of an arrangement 700 of a device 600 and the fluid coupler 500 of FIGS. 5-6. As shown, the cylindrical-shaped film layer traverse channel 401 defines a corresponding film layer traverse channel axial 401.1 that is generally orthogonal to the plural film layers 20, the film layer top surface 21 and the film layer bottom surface 29.

As shown in FIG. 7, the device 600 is disposed on the film layer top surface 21 and arranged to fluidly couple with the cavity opening 420 of the film layer traverse channel 401, the cavity openings 421 and 423 of the film layer first lateral channel 402 and the cavity openings 422 and 424 of the film layer second lateral channel 403.

Referring still to FIG. 7, in one embodiment, the device 600 comprises a fluid ejector or a fluid dispenser. Also, in one embodiment, the device 600 comprises a micromechanical device or micro-electromechanical device, such devices commonly referred to simply as "MEMS" devices.

Still referring generally to FIG. 7, and more particularly referring to the device 600 depicted therein, some examples of such micromechanical, micro-electromechanical or MEMS fluid ejector or fluid dispenser devices are described in the following thirteen (13) U.S. patents: Charles P. Coleman et al., "Method of fabricating a fluid drop ejector", U.S. Pat. No. 6,127,198; Charles P. Coleman et al., "Fluid drop ejector", U.S. Pat. No. 6,318,841 B1; Frank C. Genovese et al., "Magnetically actuated ink jet printing device", U.S. Pat. No. 6,234,608 B1; Arthur M. Gooray et al., "Magnetic drive systems and methods for a micromachined fluid ejector", U.S. Pat. No. 6,350,015 B1; Arthur M. Gooray et al., "Micromachined fluid ejector systems and methods", U.S. Pat. No. 6,367,915 B1; Arthur M. Gooray et al., "Fluid ejection systems and methods with secondary dielectric fluid", U.S. Pat. No. 6,406,130 B1; Arthur M. Gooray et al., "Bi-directional fluid ejection systems and methods", U.S. Pat. No. 6,409,311 B1; Arthur M. Gooray et al., "Micromachined fluid ejector systems and methods having improved response characteristics", U.S. Pat. No. 6,416,169 B1; Arthur M. Gooray et al., "Electronic drive systems and methods", U.S. Pat. No. 6,419,335 B1; Joel A. Kubby et al., "Micro-electro-mechanical fluid ejector and method of operating same", U.S. Pat. No. 6,357,865 B1; Joel A. Kubby et al., "Method of fabricating a micro-electro-mechanical fluid ejector", U.S. Pat. No. 6,662,448 B2; Eric Peeters et al., "Print head for use in a ballistic aerosol marking apparatus", U.S. Pat. No. 6,116,718; and Kia Silverbrook, "Method of manufacture of a thermally actuated ink jet including a tapered heater element", U.S. Pat. No. 6,180,427 B1; the disclosures of which thirteen (13) U.S. patents are hereinabove incorporated by reference, verbatim, and with the same effect as though the same disclosures were fully and completely set forth herein.

Referring still to FIG. 7, in one embodiment, the device 600 comprises a sensing device, a sensor, a bioprocessing device or a device for processing biological fluids.

Figure 8:
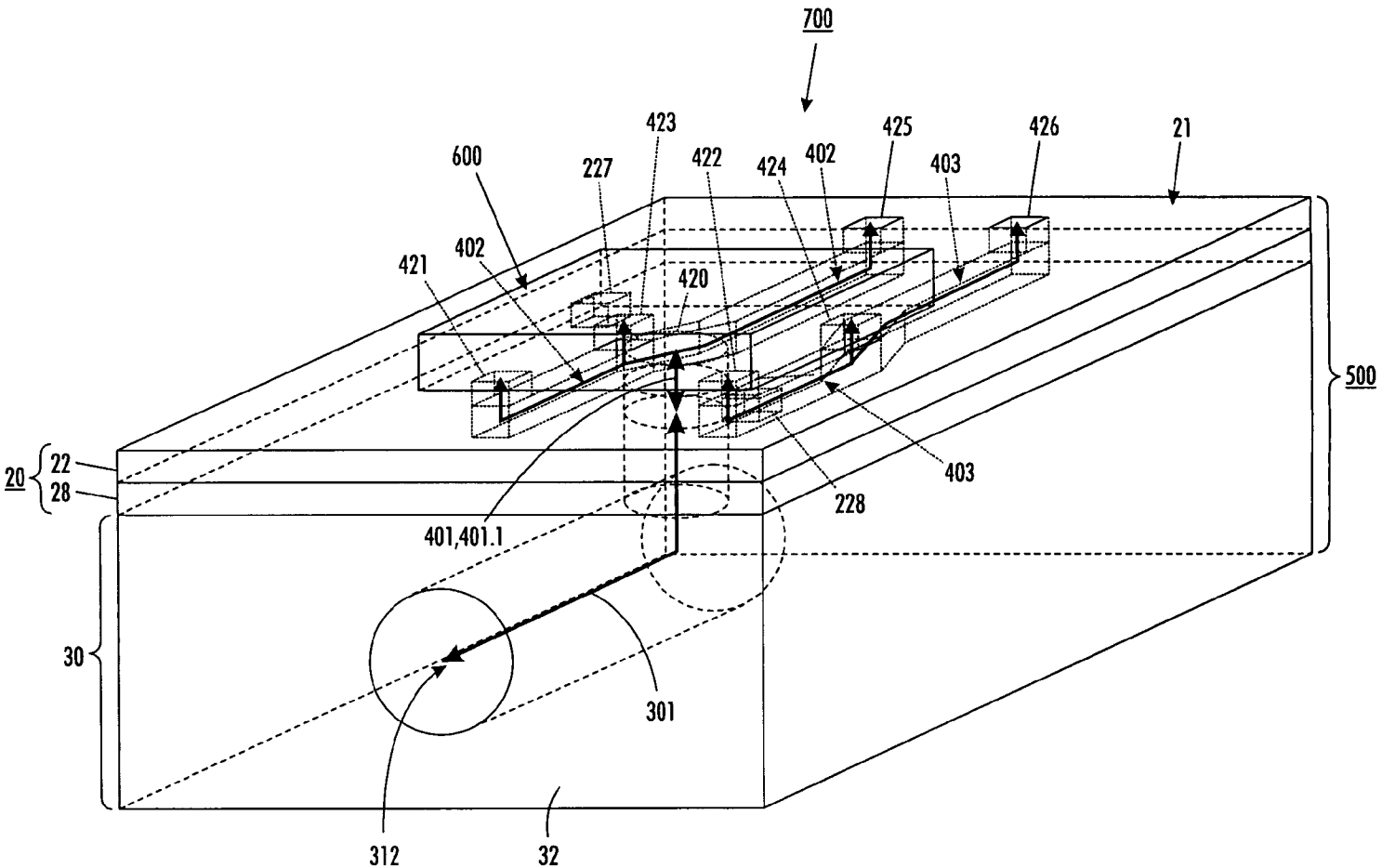
FIG. 8 is a further view of the arrangement 700 of FIG. 7.

Referring to FIG. 8, there is shown a further view of the arrangement 700 of FIG. 7. As shown, the device 600 is disposed on the film layer top surface 21 and arranged to fluidly couple with the five (5) cavity openings 420, 421, 422, 423 and 424, thus fluidly coupling with the film layer traverse channel 401 and the film layer first and second lateral channels 402 and 403.

Referring still to FIG. 8, the first film layer lateral channel 402 couples three (3) cavity openings 421, 423 and 425. As shown, these cavity openings 421, 423, 425 are disposed to the left of the film layer traverse channel axial 401.1, with a first cavity opening 421 disposed in front of the film layer traverse channel axial 401.1, a second cavity opening 423 disposed to the rear of the film layer traverse channel axial 401.1, and a third cavity opening 425 disposed to the rear of the second cavity opening 423.

Still referring to FIG. 8, the film layer second lateral channel 403 couples three (3) cavity openings 422, 424 and 426. As shown, these cavity openings 422, 424, 426 are disposed to the right of the film layer traverse channel axial 401.1, with a first cavity opening 422 disposed in front of the film layer traverse channel axial 401.1, a second cavity opening 424 disposed to the rear of the film layer traverse channel axial 401.1, and a third cavity opening 426 disposed to the rear of the second cavity opening 424.

Referring still to FIG. 8, the first and second cavity openings 421, 423 of the film layer first lateral channel 402 and the first and second cavity openings 422, 424 of the film layer second lateral channel 403 are disposed generally equidistant from the film layer traverse channel axial 401.1.

Still referring to FIG. 8, the following sentences refer to various embodiments of the arrangement 700:

In one embodiment, the device 600 comprises a member of a group of devices comprising a fluid ejector, a fluid dispenser, a sensing device, a sensor, a bioprocessing device, a bioprocessor and a device for processing biological fluids.

In one embodiment, the device 600 comprises any of a micromechanical device, a micro-electromechanical device and a MEMS device.

In one embodiment, the film layer traverse channel 401 and the film layer first and second lateral channels 402-403 are arranged to transport or flow one or more fluids that are members of a group of fluids comprising a fragrance, a perfume, a therapeutic, a mood-enhancing agent, a pheromone, a moisturizer, a humectant, a miticide, a deodorizer, a disinfectant, a sanitizing agent, an insecticide, an atmospheric substance, air, a biological fluid and a marking fluid. In the foregoing group of fluids, the term "atmospheric substance" means any substance that is dispersed or suspended in the atmosphere or environmental air proximate to the device 600, such substance including, but not limited to, a human body fluid in liquid or gaseous form, an odor or fragrance that is formed by a human body, or any combination of these human products. Also in the foregoing group of fluids, the term "marking fluid" includes without limitation ink.

Thus, there is described a process for a combined die attach that includes multi-layer media interface capability. By using layers of self-adhesive structural plastic films or else layers of structural bonding tape that are laser cut or cast or die cut, high accuracy multi-layer pathways can be integrated with the die or substrate assembly. This process reduces the complexity of the main underlying substrate, thus reducing cost and increasing yield. Additional benefits are derived by eliminating adhesive material displacement during assembly, providing an instant assembly without fixturing, and improved throughput. The integration of die attach with media distribution provides the opportunity to achieve complex functionality with flexibility and low-cost assembly techniques. Extension to multi-chip assemblies, such as multi-chip ink jet printheads, is also described.

One embodiment of the present invention is shown in FIG. 8. Referring to FIG. 8, the embodiment shown therein is a Fluidic MEMS drop ejector. The die module 600 requires both a liquid (ink) and an air interface. In one embodiment, the die size is about 5 mm square, and the two different ports are in very close proximity to each other.

Still referring to FIG. 8, in one embodiment, the base substrate 30 is an aluminum block with a 2 mm hole drilled into it. In one embodiment, the integrated die attach and air venting porting are accomplished by using two layers 22 and 28 of structural adhesive film or else structural bonding tape that were laser cut by a laser ablation process according to CAD data. The two film layers provide a through hole 401 in the center of the die for the liquid interface. They also provide a buried air pathway 402 and 403 from the vent ports 421, 422, 423 and 424 at the corners of the die 600 and are routed to a region 425 and 426 removed from the active die area. This air venting provided by the air pathway 402 and 403 allows for ambient pressure equalization behind the ejector membranes.

This invention has been reduced to practice and is applicable for all packaging of this device. Assembly complexity and material waste has been significantly reduced. At the same time, yield loss has been eliminated, achieving 100 per-cent over a large number of assemblies.

Returning again to FIGS. 1-3, there is depicted the key steps in developing the die attach layer. FIG. 1 shows the upper or top film layer 22 and FIG. 2 shows the lower or bottom film layer 28. In practice, one layer (corresponding to the bottom film layer 28 shown in FIG. 2) is laser processed forming the CAD controlled features. A protective liner layer is removed from the film and the next blank layer (corresponding to the top film layer 22 shown in FIG. 1) is applied, thus forming a film layer stack. The top film layer 22 is then processed according to the next set of CAD data, thus forming the final part (corresponding to the plural film layers 20 shown in FIG. 3). Note that this implementation, that is, the plural film layers 20 of FIG. 3, only has two film layers 22 and 28, however, there is no real limit to how many total film layers can be used in any particular application.

Referring still to FIG. 3, in one embodiment, the film material used in fabricating the depicted plural film layers 20 is the 9244 Structural Bonding Tape, available from 3M Corporation, Saint Paul, Minn. This material is tacky on both sides and is supplied with the protective liner mentioned above. Due to the tacky property of the adhesive, the completed component is self-fixturing. Once the assembly is mated together, the system is placed in an oven heated to about 150 degrees Celsius to fully cure the adhesive layers. When cured, the assembly is complete and can then proceed to additional process steps.

Still referring to FIG. 3, in one embodiment, the film material used in fabricating the depicted plural film layers 20 comprises a film adhesive or a double-sided tape, wherein the double-sided tape may comprise, for example, any of thermoset and thermoplastic polymer films.

Referring still to FIG. 3, in one embodiment, the film material used in fabricating the depicted plural film layers 20 comprises any of a thermoset material such as, for example, an acrylic adhesive, an epoxy, a silicone, a nitrile and a phenolic and a thermoplastic material such as, for example, a polyester, a polyetherimide, a polysulfone, a polyethersulfone, a polyetherketone, a polyetherimide and a polyphenylenesulfide.

The embodiment depicted in FIGS. 1-3 includes additional features enabled by this invention. The die module 600 requires an electrical interface to the control electronics. A printed circuit board is placed next to the die 600 and wire-bonded to the I/O pads. Previous package designs require separate fastening techniques such as screws or adhesive tape. Since this multi-layer interconnect is adhesive, the circuit board can be placed on the substrate 30 at the same time as die attach, thus reducing component count. Additionally, the reduced materials set provides better materials compatibility for improved system engineering.

Another benefit is the ability to generate fiducial or alignment marks in the laser-processed layers. Features can be opened up to allow easy alignment to the substrate 30, and subsequently, easy die alignment to the media pathways. In the depicted embodiment, two features 227 and 228 were created at diagonally-opposite corners of the die module 600 to facilitate die alignment during assembly. This ensures that the fluid ink pathway 401 and the air venting pathways 402 and 403 align to their mating features, thus permitting high yield.

In summary, some advantages of the present invention include the following:

First, elimination of liquid adhesives and their associated handling equipment and overhead;

Second, high resolution-high density routing and sealing of various media materials;

Third, self fixturing (no clamping) assembly;

Fourth, high yield due to reduced media crosstalk and improved seal integrity;

Fifth, reduced cost of substrates due to lower tolerance requirements;

Sixth, ability to integrate many levels of assembly; and

Seventh, allow for built-in alignment features to improve yield.

Moreover, this invention can be extended to arrays of die, such as an ink jet printhead made from several die that are abutted or placed in proximity with specific alignment required. Routing two to four different colored inks could be accomplished without difficulty. A three-layer connector, using the two attached substrates can allow for fluid pathway cross-overs when feeding fluid from a manifold on one side to a die having several fluids sent or supplied to on the other side. Additional layers could permit even more complex routing.

Thus, there has been described the first aspect of the invention, namely, the fluid coupler 500 comprising plural film layers 20 disposed on the substrate top surface 31 of an included substrate 30, the plural film layers 20 disposed with respect to one another to define a top film layer 22 and a bottom film layer 28, the top film layer 22 defining a film layer top surface 21 and the bottom film layer 28 defining a film layer bottom surface 29, each film layer 22, 28 having two opposing film layer sides with a corresponding film layer thickness or spacing 229, 289 therebetween, each film layer 22, 28 further having one or more regions that are devoid of film material, each film layer thus forming one or more cavities 220-228, 280, 281, 284 with corresponding cavity openings on both of its film layer sides, each film layer having one or more of its cavities disposed to provide fluid coupling with its respective adjacent film layer or with both of its respective adjacent film layers, as the case may be, the plural film layers 20 disposed to form at least one film layer traverse channel 401 coupling at least one cavity opening 420 in the film layer top surface 21 with at least one cavity opening 480 in the film layer bottom surface 29.

The following sentences refer to various embodiments of the first aspect of the invention:

In one embodiment, the plural film layers 20 form one or more film layer lateral channels 402, 403, each film layer lateral channel coupling a corresponding group of cavity openings 421-423-425, 422-424-426 in the film layer top surface 21.

In one embodiment, the substrate 30 comprises at least one substrate channel 301 coupling at least one substrate opening 311 in the substrate top surface 31 with one or more additional substrate openings 312-316 comprised in one or more substrate surfaces of an included substrate front surface 32, substrate back surface 33, substrate left side surface 34, substrate right side surface 35 and substrate bottom surface 36, the plural film layers 20 disposed such that at least one film layer traverse channel 401 fluidly couples with at least one substrate channel 301.

In one embodiment, the fluid coupler 500 comprises a film layer traverse channel 401 coupling exactly one (1) cavity opening 420 in the film layer top surface 21 with exactly one (1) cavity opening 480 in the film layer bottom surface 29.

In one embodiment, the fluid coupler 500 comprises a substrate channel 301 coupling exactly one (1) substrate opening 311 in the substrate top surface 31 with exactly one (1) additional substrate opening 312 comprised in the substrate front surface 32.

Also, there has been described the second aspect of the invention, namely, the fluid coupler 500 comprising plural film layers 20 disposed on the substrate top surface 31 of an included substrate 30, the plural film layers 20 disposed with respect to one another to define a top film layer 22 and a bottom film layer 28, the top film layer 22 defining a film layer top surface 21, each film layer 22, 28 having two opposing film layer sides with a corresponding film layer thickness or spacing 229, 289 therebetween, each film layer 22, 28 further having one or more regions that are devoid of film material, each film layer thus forming one or more cavities 220-228, 280, 281, 284 with corresponding cavity openings on both of its film layer sides, each film layer having one or more of its cavities disposed to provide fluid coupling with its respective adjacent film layer or with both of its respective adjacent film layers, as the case may be, the plural film layers 20 thus forming one or more film layer lateral channels 402, 403, each film layer lateral channel coupling a corresponding group of cavity openings 421-423-425, 422-424-426 in the film layer top surface 21.

The following sentences refer to various embodiments of the second aspect of the invention:

In one embodiment, the bottom film layer 28 defines a film layer bottom surface 29, the plural film layers 20 disposed to form at least one film layer traverse channel 401 coupling at least one cavity opening 420 in the film layer top surface 21 with at least one cavity opening 480 in the film layer bottom surface 29.

In one embodiment, the substrate 30 comprises at least one substrate channel 301 coupling at least one substrate opening 311 in the substrate top surface 31 with one or more additional substrate openings 312-316 comprised in one or more substrate surfaces of an included substrate front surface 32, substrate back surface 33, substrate left side surface 34, substrate right side surface 35 and substrate bottom surface 36, the plural film layers 20 disposed such that at least one film layer traverse channel 401 fluidly couples with at least one substrate channel 301.

In one embodiment, the coupler 500 comprises a film layer traverse channel 401 coupling exactly one (1) cavity opening 420 in the film layer top surface 21 with exactly one (1) cavity opening 480 in the film layer bottom surface 29.

In one embodiment, the coupler comprises a substrate channel 301 coupling exactly one (1) substrate opening 311 in the substrate top surface 31 with exactly one (1) additional substrate opening 312 comprised in the substrate front surface 32.

Also, there has been described the third aspect of the invention, namely, the arrangement 700 comprising a device 600 and a fluid coupler 500, the fluid coupler 500 comprising plural film layers 20 disposed on the substrate top surface 31 of an included substrate 30, the plural film layers 20 disposed with respect to one another to define a top film layer 22 and a bottom film layer 28, the top film layer 22 defining a film layer top surface 21, each film layer 22, 28 having two opposing film layer sides with a corresponding film layer thickness or spacing 229, 289 therebetween, each film layer 22, 28 further having one or more regions that are devoid of film material, each film layer thus forming one or more cavities 220-228, 280, 281, 284 with corresponding cavity openings on both of its film layer sides, each film layer having one or more of its cavities disposed to provide fluid coupling with its respective adjacent film layer or with both of its respective adjacent film layers, as the case may be, the device 600 arranged to fluidly couple with one or more cavity openings 420-424 in the film layer top surface 21.

The following sentences refer to various embodiments of the third aspect of the invention:

In one embodiment, the plural film layers 20 form one or more film layer lateral channels 402, 403, each film layer lateral channel coupling a corresponding group of cavity openings 421-423-425, 422-424-426 in the film layer top surface 21.

In one embodiment, the bottom film layer 28 defines a film layer bottom surface 29, the plural film layers 20 disposed to form at least one film layer traverse channel 401 coupling at least one cavity opening 420 in the film layer top surface 21 with at least one cavity opening 480 in the film layer bottom surface 29.

In one embodiment, the substrate 30 comprises at least one substrate channel 301 coupling at least one substrate opening 311 in the substrate top surface 31 with one or more additional substrate openings 312-316 comprised in one or more substrate surfaces of an included substrate front surface 32, substrate back surface 33, substrate left side surface 34, substrate right side surface 35 and substrate bottom surface 36, the plural film layers 20 disposed such that at least one film layer traverse channel 401 fluidly couples with at least one substrate channel 301.

In one embodiment, the fluid coupler 500 comprises a film layer traverse channel 401 coupling exactly one (1) cavity opening 420 in the film layer top surface 21 with exactly one (1) cavity opening 480 in the film layer bottom surface 29.

In one embodiment, the film layer traverse channel 401 is generally cylindrical-shaped thus defining a film layer traverse channel axial 401.1, an included film layer first lateral channel 402 coupling first, second, and third cavity openings 421, 423, 425, an included film layer second lateral channel 403 coupling fourth, fifth and sixth cavity openings 422, 424, 426, with the first, second, fourth and fifth cavity openings 421, 423, 422, 424 being generally equidistant from the film layer traverse channel axial 401.1.

Also, there has been described the fourth aspect of the invention, namely, the arrangement 700 comprising a device 600 and a fluid coupler 500, the fluid coupler 500 comprising plural film layers 20 disposed on the substrate top surface 31 of an included substrate 30, the plural film layers 20 disposed with respect to one another to define a top film layer 22 and a bottom film layer 28, each film layer 22, 28 having two opposing film layer sides with a corresponding film layer thickness or spacing 229, 289 therebetween, each film layer 22, 28 further having regions that are devoid of film material, thus forming film layer cavities 220-228, 280, 281, 284 with corresponding cavity openings in both of the film layer's sides, each film layer having its cavities disposed to provide fluid coupling with its adjacent film layer or with its adjacent film layers, as the case may be, the plural film layers 20 thus forming a film layer traverse channel 401 coupling the top film layer 22 and the bottom film layer 28 and further forming one or more film layer lateral channels 402, 403 coupling cavity openings 421-426 in the top film layer 22, the film layer traverse channel 401 fluidly coupling with a substrate channel 301 comprised in the substrate top surface 31 and extending to one or more additional substrate surfaces 32-36, the device 600 fluidly coupled with one or more of the film layer traverse channel 401 and the one or more film layer lateral channels 402, 403.

The table below lists the drawing element reference numbers together their corresponding written description:

| Ref. No.: | Description: |
|---|---|
| 20 | plural film layers |
| 21 | film layer top surface |
| 22 | top film layer |
| 28 | bottom film layer |
| 29 | film layer bottom surface |
| 30 | substrate |

-continued

| Ref. No.: | Description: |
|---|---|
| 31 | substrate top surface |
| 32 | substrate front surface |
| 33 | substrate back surface |
| 34 | substrate left side surface |
| 35 | substrate right side surface |
| 36 | substrate bottom surface |
| 38 | substrate right front edge |
| 39 | substrate left front edge |
| 220 | top film layer circular cavity |
| 221 | top film layer left front cavity |
| 222 | top film layer right front cavity |
| 223 | top film layer left middle cavity |
| 224 | top film layer right middle cavity |
| 225 | top film layer left back cavity |
| 226 | top film layer right back cavity |
| 227 | top film layer left corner cavity |
| 228 | top film layer right corner cavity |
| 229 | top film layer thickness or spacing |
| 280 | bottom film layer circular cavity |
| 281 | bottom film layer left cavity |
| 281A | bottom film layer left cavity first segment |
| 281B | bottom film layer left cavity second segment |
| 281C | bottom film layer left cavity third segment |
| 281X | bottom film layer left cavity first segment front end |
| 281Y | bottom film layer left cavity first segment back end |
| 281Z | bottom film layer left cavity third segment back end |
| 284 | bottom film layer right cavity |
| 284A | bottom film layer right cavity first segment |
| 284B | bottom film layer right cavity second segment |
| 284C | bottom film layer right cavity third segment |
| 284X | bottom film layer right cavity first segment front end |
| 284Y | bottom film layer right cavity first segment back end |
| 284Z | bottom film layer right cavity third segment back end |
| 289 | bottom film layer thickness or spacing |
| 301 | substrate channel or pathway |
| 311 | substrate top opening |
| 312 | substrate front opening |
| 313 | substrate back opening |
| 314 | substrate left side opening |
| 315 | substrate right side opening |
| 316 | substrate bottom opening |
| 401 | film layer traverse channel or pathway |
| 401.1 | film layer traverse channel or pathway axial |
| 402 | film layer first or left-side lateral channel or pathway |
| 403 | film layer second or right-side lateral channel or pathway |
| 420 | cavity opening in film layer top surface |
| 421 | cavity opening in film layer top surface |
| 422 | cavity opening in film layer top surface |
| 423 | cavity opening in film layer top surface |
| 424 | cavity opening in film layer top surface |
| 425 | cavity opening in film layer top surface |
| 426 | cavity opening in film layer top surface |
| 427 | cavity opening in film layer top surface |
| 428 | cavity opening in film layer top surface |
| 480 | cavity opening in film layer bottom surface |
| 481 | cavity opening in film layer bottom surface |
| 484 | cavity opening in film layer bottom surface |
| 500 | fluid coupler |
| 600 | device |
| 700 | the device 600 arranged with the fluid coupler 500 |

The claims, as originally presented and as they may be amended, encompass variations, alternatives, modifications, improvements, equivalents and substantial equivalents of the embodiments and teachings disclosed herein, including those that are presently unforeseen or unappreciated and that, for example, may arise from applicants, patentees and others.

What is claimed is:

1. A fluid coupler comprising plural film layers disposed on the substrate top surface of an included substrate, the plural film layers disposed with respect to one another to define a top film layer and a bottom film layer, the top film layer defining a film layer top surface and the bottom film layer defining a film layer bottom surface, each film layer having two opposing film layer sides with a corresponding film layer thickness or spacing therebetween, each film layer further having one or more regions that are devoid of film material, each film layer thus forming one or more cavities with corresponding cavity openings on both of its film layer sides, each film layer having one or more of its cavities disposed to provide fluid coupling with its respective adjacent film layer or with both of its respective adjacent film layers, as the case may be, the plural film layers disposed to form at least one film layer traverse channel coupling at least one cavity opening in the film layer top surface with at least one cavity opening in the film layer bottom surface, the plural film layers comprising any of structural bonding tape, adhesive films and double-sided tape.

2. The fluid coupler of claim 1, the plural film layers forming one or more film layer lateral channels, each film layer lateral channel coupling a corresponding group of cavity openings in the film layer top surface.

3. The fluid coupler of claim 2, the substrate comprising at least one substrate channel coupling at least one substrate opening in the substrate top surface with one or more additional substrate openings comprised in one or more substrate surfaces of an included substrate front surface, substrate back surface, substrate left side surface, substrate right side surface and substrate bottom surface, the plural film layers disposed such that at least one film layer traverse channel fluidly couples with at least one substrate channel.

4. The fluid coupler of claim 3 comprising the film layer traverse channel coupling exactly one (1) cavity opening in the film layer top surface with exactly one (1) cavity opening in the film layer bottom surface.

5. A fluid coupler comprising plural film layers disposed on the substrate top surface of an included substrate, the plural film layers disposed with respect to one another to define a top film layer and a bottom film layer, the top film layer defining a film layer top surface, each film layer having two opposing film layer sides with a corresponding film layer thickness or spacing therebetween, each film layer further having one or more regions that are devoid of film material, each film layer thus forming one or more cavities with corresponding cavity openings on both of its film layer sides, each film layer having one or more of its cavities disposed to provide fluid coupling with its respective adjacent film layer or with both of its respective adjacent film layers, as the case may be, the plural film layers thus forming one or more film layer lateral channels, each film layer lateral channel coupling a corresponding group of cavity openings in the film layer top surface, the plural film layers comprising any of structural bonding tape, adhesive films and double-sided tape.

6. The fluid coupler of claim 5, the bottom film layer defining a film layer bottomsurface, the plural film layers disposed to form at least one film layer traverse channel coupling at least one cavity opening in the film layer top surface with at least one cavity opening in the film layer bottom surface.

7. The fluid coupler of claim 6 comprising the film layer traverse channel coupling exactly one (1) cavity opening in the film layer top surface with exactly one (1) cavity opening in the film layer bottom surface.

8. A device arranged with plural film layers, the plural film layers disposed on the substrate top surface of an included substrate, the plural film layers disposed with respect to one another to define a top film layer and a bottom film layer, the top film layer defining a film layer top surface, each film layer having two opposing film layer sides with a corresponding film layer thickness or spacing therebetween, each film layer further having one or more regions that are devoid of film material, each film layer thus forming one or more cavities with corresponding cavity openings on both of its film layer sides, each film layer having one or more of its cavities disposed to provide fluid coupling with its respective adjacent film layer or with both of its respective adjacent film layers, as the case may be, the device arranged to fluidly couple with one or more cavity openings in the film layer top surface, the device being disposed on the film layer top surface of the top film layer, and the plural film layers comprising exactly two (2) film layers.

9. The device arranged with plural film layers of claim 8, the plural film layers forming one or more film layer lateral channels, each film layer lateral channel coupling a corresponding group of cavity openings in the film layer top surface.

10. The device arranged with plural film layers of claim 9, the bottom film layer defining a film layer bottom surface, the plural film layers disposed to form at least one film layer traverse channel coupling at least one cavity opening in the film layer top surface with at least one cavity opening in the film layer bottom surface.

11. The device arranged with plural film layers of claim 10, the substrate comprising at least one substrate channel coupling at least one substrate opening in the substrate top surface with one or more additional substrate openings comprised in one or more substrate surfaces of the included substrate front surface, substrate back surface, substrate left side surface, substrate right side surface and substrate bottom surface, the plural film layers disposed such that at least one film layer traverse channel fluidly couples with at least one substrate channel.

12. The device arranged with plural film layers of claim 11, the device comprising any of a fluid ejector, a fluid dispenser, a sensing device, a sensor, a bioprocessing device, a bioprocessor and a device for processing biological fluids.

13. The device arranged with plural film layers of claim 11, the plural film layers comprising any of structural bonding tape, adhesive films and double-sided tape.

14. A device arranged with plural film layers, the plural film layers disposed on the substrate top surface of an included substrate, the plural film layers disposed with respect to one another to define a top film layer and a bottom film layer, each film layer having two opposing film layer sides with a corresponding film layer thickness or spacing therebetween, each film layer further having regions that are devoid of film material, thus forming film layer cavities with corresponding cavity openings in both of the film layer's sides, each film layer having its cavities disposed to provide fluid coupling with its adjacent film layer or with its adjacent film layers, as the case may be, the plural film layers thus forming a film layer traverse channel coupling the top film layer and the bottom film layer and further forming one or more film layer lateral channels coupling cavity openings in the top film layer, the film layer traverse channel fluidly coupling with a substrate channel comprised in the substrate top surface and extending to one or more additional substrate surfaces, the device fluidly coupled with one or more of the film layer traverse channel and the one or more film layer lateral channels, the device being disposed on the film layer top surface of the top film layer, and the plural film layers comprising any of structural bonding tape, adhesive films and double-sided tape.

15. The device arranged with plural film layers of claim 14, the device comprising any of a fluid ejector, a fluid dispenser, a sensing device, a sensor, a bioprocessing device, a bioprocessor and a device for processing biological fluids.

* * * * *